US008813276B2

(12) United States Patent
Lee et al.

(10) Patent No.: US 8,813,276 B2
(45) Date of Patent: Aug. 26, 2014

(54) PATIENT TURNING SYSTEM AND METHOD

(75) Inventors: Laura W. Lee, Keswick, VA (US); Alexander V. Stronko, Charlottesville, VA (US); Taylor R. Blake, Centreville, VA (US); Tina Ansari, Colonial Heights (CA); Jemshaid Shams, Springfield, VA (US)

(73) Assignees: Laura Lee, Atlanta, GA (US); Alexander Stronko, Charlottesville, VA (US)

( * ) Notice: Subject to any disclaimer, the term of this patent is extended or adjusted under 35 U.S.C. 154(b) by 489 days.

(21) Appl. No.: 12/701,970

(22) Filed: Feb. 8, 2010

(65) Prior Publication Data

US 2010/0199425 A1 Aug. 12, 2010

Related U.S. Application Data

(60) Provisional application No. 61/151,015, filed on Feb. 9, 2009.

(51) Int. Cl.
*A61G 7/00* (2006.01)
*A61G 7/10* (2006.01)

(52) U.S. Cl.
CPC ..... *A61G 7/001* (2013.01); *A61G 7/1015* (2013.01); *A61G 7/1051* (2013.01)
USPC ..... 5/81.1 T; 5/83.1; 5/482; 5/495

(58) Field of Classification Search
USPC ..... 5/610, 83.1, 85.1, 87.1, 88.1, 84.1, 5/89.1, 81.1 T, 500, 502, 942, 504.1, 5/505.1, 513, 486, 482, 495, 496, 499, 5/81.1 R, 497; 212/901; 414/921
See application file for complete search history.

(56) References Cited

U.S. PATENT DOCUMENTS

| | | | | |
|---|---|---|---|---|
| 3,383,717 | A | | 5/1968 | Underwood |
| 3,775,781 | A | * | 12/1973 | Bruno et al. ..... 5/607 |
| 3,884,225 | A | | 5/1975 | Witter |
| 4,069,526 | A | * | 1/1978 | Deikel ..... 5/486 |
| 4,680,821 | A | * | 7/1987 | Maguire ..... 5/413 R |
| 4,949,414 | A | | 8/1990 | Thomas et al. |
| 5,068,931 | A | * | 12/1991 | Smith ..... 5/84.1 |
| 5,092,007 | A | | 3/1992 | Hasty |
| 5,155,874 | A | * | 10/1992 | Kershaw ..... 5/81.1 T |
| 5,161,267 | A | | 11/1992 | Smith |
| 5,168,587 | A | | 12/1992 | Shutes |
| 5,210,887 | A | | 5/1993 | Kershaw |
| 5,274,862 | A | | 1/1994 | Palmer, Jr. et al. |
| 5,315,723 | A | | 5/1994 | Smith |

(Continued)

FOREIGN PATENT DOCUMENTS

| | | | |
|---|---|---|---|
| EP | 0 310 715 | A1 | 12/1989 |
| GB | 2 302 013 | A | 1/1997 |
| WO | WO 01/04158 | A1 | 7/2001 |

*Primary Examiner* — Nicholas Polito
(74) *Attorney, Agent, or Firm* — Law Office of Alan W. Cannon

(57) ABSTRACT

Systems and methods for turning a bedridden patient are described. A turn sheet system for turning a patient in a bed includes a bottom sheet having a first length and a first width configured and dimensioned to overlie the bed. A top sheet having a second length and a second width is fixed to the bottom sheet along a location extending intermediate of the second width and along a majority of the second length.

18 Claims, 5 Drawing Sheets

(56) References Cited

U.S. PATENT DOCUMENTS

| | | | | | |
|---|---|---|---|---|---|
| 5,329,655 | A | | 7/1994 | Garner | |
| 5,457,830 | A | * | 10/1995 | Fox et al. | 5/486 |
| 5,544,371 | A | | 8/1996 | Fuller | |
| 5,560,057 | A | | 10/1996 | Madsen et al. | |
| 5,659,905 | A | | 8/1997 | Palmer, Jr. et al. | |
| 5,673,443 | A | | 10/1997 | Marmor | |
| 6,065,162 | A | | 5/2000 | Behr | |
| 6,119,292 | A | | 9/2000 | Haas | |
| 6,154,900 | A | | 12/2000 | Shaw | |
| 6,237,171 | B1 | * | 5/2001 | Allen | 5/482 |
| 6,321,398 | B1 | * | 11/2001 | Wang | 5/81.1 R |
| 6,393,636 | B1 | | 5/2002 | Wheeler | |
| 6,496,991 | B1 | | 12/2002 | Votel | |
| 6,560,793 | B2 | * | 5/2003 | Walker | 5/81.1 T |
| 6,560,797 | B2 | * | 5/2003 | Maturaporn | 5/482 |
| 6,658,676 | B1 | | 12/2003 | Persson et al. | |
| 7,007,330 | B2 | | 3/2006 | Kuiper et al. | |
| 2005/0103350 | A1 | | 5/2005 | Henry | |

* cited by examiner

PATIENT TURNING SYSTEM AND METHOD

CROSS-REFERENCE

This application claims the benefit of U.S. Provisional Application No. 61/151,015, filed Feb. 9, 2009, which application is incorporated herein, in its entirety, by reference thereto.

BACKGROUND OF THE INVENTION

According to the United States Census Bureau, in 2007 the American population over the age of 65 years was an estimated number of 37,887,958. Furthermore, the number of baby boomers, people born between 1946 and 1964, was about 78.2 million, 74% of which are expected to be between ages 66 and 84 in the year 2030. Compared to the rest of the population, the elderly are more susceptible to health problems and immobility, which may lead to their hospitalization or bed rest at nursing or personal homes. One of the most serious problems with these elderly patients is the increased risk of pressure ulcer development due to the prolonged pressure on their bodies. Pressure ulcers develop on bony protrusions when an outside force restricts the internal capillary pressure for a period of 2 to 6 hours from a healthy range of 20 to 40 mmHg. The incidence of pressure ulcers ranges from 1.3 to 3 million cases within the hospital setting. In addition to pressure ulcers, urinary and fecal incontinence also afflicts a large proportion of the elderly population, which can also contribute to the formation of pressure ulcers by exposing the skin to moisture and to caustic urine or feces. This exposure can lead to delayed healing and also infections of the deep tissues or underlying bone, a cause of severe morbidity or mortality in the frail elderly and immobile population.

The capability to roll an immobile patient in bed on a regular basis is critical to the patient's quality of care. Immobile patients need to be turned every two hours, in order to be protected from the risk of pressure ulcer development. The regular turning of a patient also provides caregivers the proactive opportunity to handle incontinence episodes from developing into extensive problems. The current method for turning a patient is performed manually by two or more caregivers. Regular lifting and moving of patients puts a great amount of load on the caregiver's musculoskeletal system. Healthcare workers have one of the highest incident rates of back pain and musculoskeletal injuries. Among these healthcare providers, nurses have the highest rate of musculoskeletal pain, which is mainly due to manual patient handling. These pains are dominantly experienced in the neck, shoulders, and the lower back, which could further lead to skeletal defects. Nurses with these defects become even more susceptible to occupational injury, which is one of the leading causes of nursing shortage in healthcare.

Studies show that the mandated use of mechanical patient lift devices is potentially the top solution to preventing back pains and injuries in healthcare providers. Unfortunately, devices that are currently available are not widely used by caregivers, as they address a limited amount of the bedridden patients' needs. These devices do not address and solve all the problems associated with turning a patient in an efficient and feasible manner. Although some turn the patient, they do not allow for proper cleaning of the patient. Other current technologies are bulky, expensive, and overall infeasible. Some also require two caregivers to turn the patient, when ideally only a single caregiver should be needed.

Currently available devices for automated turning of patients include air mattresses configured to assist in turning a patient and systems requiring ceiling rails to provide leverage for automated lifting. The air mattress systems are typically limited in function because they only allow patient turning up to thirty degrees. This will relieve pressure to reduce pressure sore development, but it does not allow the caregiver to turn the patient ninety degrees to clean up after an incontinence episode. The rail systems will generally allow complete access to clean up, but the infrastructure required for these systems is very daunting and specific. Only specific infrastructure frames will work for the rail system. Thus such systems are not practical for home use and generally are not readily interchangeable even for use in hospitals, nursing homes, etc.

Other currently available systems employ a turn sheet for turning a patient. For example, Kershaw, in U.S. Pat. Nos. 5,155,874 and 5,210,887 employs a turn sheet for turning an invalid from a back rest position to a side rest position. However, the turn sheet used is made of a heavy gauge canvas fabric, which is typically uncomfortable to the patient and may propose difficulties to wash, particularly for at home users. Even more importantly, a material that is rough to the skin can severely damage immobile patients as they are prone to pressure sore development, and also have fragile skin. Also, there is no safety mechanism provided to prevent or significantly reduce the risk of turning the patient over too far and/or rolling the patient off of the bed. Still further, there is no feature provided to maintain the turn sheet in the desired position and thus there is a potential for the sheet to be mispositioned/slid from its intended position.

There is a continuing need for automated patient turning systems to relieve the burden on caregivers and nursing staff to clean and care for bedridden patients that require turning.

There is a continuing need for automate patient turning systems that are relatively inexpensive and which can readily be employed for home use as well as in institutional settings such as hospitals and nursing homes.

The present invention meets the above and other needs.

SUMMARY OF THE INVENTION

In one aspect of the present invention, a turn sheet system for turning a patient in a bed is provided that includes: a bottom sheet having a first length and a first width configured and dimensioned to overlie the bed; and a top sheet having a second length and a second width; wherein the top sheet is fixed to the bottom sheet along a location extending intermediate of the second width and along a majority of the second length.

In at least one embodiment, the top sheet is fixed along a line extending in the middle of the second width dimension, in a direction along the second length.

In at least one embodiment, the top sheet is fixed to the bottom sheet by sewing the top sheet to the bottom sheet.

In at least one embodiment, the bottom sheet is a fitted sheet configured and dimensioned to fit to the bed, thereby anchoring the system relative to the bed.

In at least one embodiment, the top sheet is reinforced lengthwise along first and second side portions thereof with a reinforcing material different from a sheet material that the top sheet is made from, to form reinforced, longitudinal border portions of the top sheet.

In at least one embodiment, reinforced holes are formed in the longitudinal border portions.

In at least one embodiment, the top sheet is affixed to a side of the bed when not being used for lifting.

In one aspect of the present invention, a system for tuning a patient in bed is provided that includes: a turn sheet assembly comprising a bottom sheet having a first length and a first width configured and dimension to overlie the bed and a top sheet having a second length and a second width, wherein the top sheet is fixed to the bottom sheet along a location extending intermediate of the second width; a reinforced longitudinal border portion formed in the top sheet; a plurality of reinforced openings formed in the longitudinal border portion; a lifting device attachable to the bed and including a boom extending over and above the bed; and attachment hardware configured and dimensioned to temporarily attach the reinforced openings to the lifting mechanism; wherein the lifting mechanism includes a lifting mechanism configured and dimensioned to apply a lifting force to the reinforced openings when attached to the lifting device, thereby lifting the reinforced longitudinal border portion.

In at least one embodiment, the attachment hardware includes a lift interface bar fixed to the lifting device, and links configured and dimensioned to pass through the reinforced openings and releasably attach the reinforced openings to the lift interface bar.

In at least one embodiment, a flexible, tensile member is routed along the boom and interconnects the lift interface bar with the lifting mechanism, wherein the lifting mechanism is configured to take up a portion of the tensile member when operated in a first direction, thereby relatively shortening a distance between the lift interface bar and the lifting mechanism and lifting the lift interface bar and the reinforced openings, thereby lifting a portion of the top sheet causing the patient to turn, the lifting mechanism being further configured to let out a portion of the tensile member when operated in a second direction, thereby relatively lengthening the distance between the lift interface bar and the lifting mechanism and lowering the lift interface bar relative to the bed.

In at least one embodiment, the links are operable by a single user to attach or detach the reinforced openings to or from the lift interface bar, and the single user requires no tools to perform the attach and detach operations.

In at least one embodiment, the top sheet is fixed to the bottom sheet along center lines dividing the top and bottom sheets in equal halves widthwise.

In at least one embodiment, the top sheet is fixed to the bottom sheet by sewing the top sheet along a line of attachment.

In at least one embodiment, the reinforced openings are reinforced by grommets.

In at least one embodiment, the bottom sheet is a commercially available fitted sheet and the top sheet is made by modifying a commercially available sheet.

In at least one embodiment, the top and bottom sheets are made of cotton or a cotton blend.

In one aspect of the present invention, a method of turning a patient in a bed is provided, including: providing a patient lying on a turn sheet assembly overlying a bed, wherein one lengthwise border portion of a top sheet of the turn sheet assembly is connected to a lifting device; operating the lifting device to apply an upward lifting force to the lengthwise border portion, thereby lifting a portion of the top sheet relative to a bottom sheet of the turn sheet assembly underlying the top sheet; and preventing lifting of the top sheet relative to the bottom sheet on a side of the top sheet opposite the lengthwise border portion that is connected to the lifting device.

In at least one embodiment, the top sheet is fixed midway between the lengthwise border portions to the bottom sheet, the method further includes fixing the bottom sheet relative to the bed.

In at least one embodiment, the method further includes turning the patient in an opposite direction, comprising: operating the lift device to lower the connected lengthwise border portion so that the top sheet contacts the bottom sheet and no lifting force is any longer applied to the connected lengthwise border portion; disconnecting the lifting device from the connected lengthwise border portion; connecting the lifting device to an opposite lengthwise border portion on the opposite side of the top sheet from the side that was previously connected to; and operating the lifting device to apply an upward lifting force to the opposite lengthwise border portion, thereby lifting a portion of the top sheet relative to a bottom sheet of the turn sheet assembly underlying the top sheet.

In at least one embodiment, the method further includes preventing lifting of the top sheet relative to the bottom sheet on a side of the top sheet nearest the lengthwise border portion that is not connected to the lifting device.

These and other features of the invention will become apparent to those persons skilled in the art upon reading the details of the systems and methods as more fully described below.

DETAILED DESCRIPTION OF THE INVENTION

Figure 1:
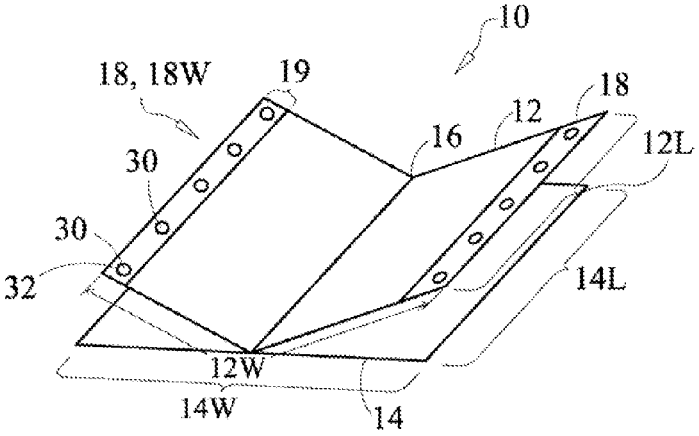
FIG. 1 is a schematic illustration of a turn sheet assembly system according to an embodiment of the present invention.

Before the present systems, devices and methods are described, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are now described. All publications mentioned herein are incorporated herein by reference to disclose and describe the methods and/or materials in connection with which the publications are cited.

It must be noted that as used herein and in the appended claims, the singular forms "a", "an", and "the" include plural referents unless the context clearly dictates otherwise. Thus, for example, reference to "a grommet" includes a plurality of such grommets and reference to "the line" includes reference to one or more lines and equivalents thereof known to those skilled in the art, and so forth.

The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates which may need to be independently confirmed.

The present invention provides a system that can be used to facilitate the turning of a bedridden patient. A lift device is connected to one side of a top sheet of a turn sheet assembly and operated to lift that side in order to turn the patient in a smooth and safe manner.

The present invention provides a simple, yet effective, patient-moving device configured to relieve significant unnecessary stress on nurses and other caregivers. The present invention will aid in alleviating the congestion in most nursing homes and hospitals by decreasing nursing labor needs and increasing the capability of home caregivers to provide necessary toileting and turning in bed. As more immobile elderly patients are given the opportunity to be cared for at home, other patients, who truly require extensive care offered in nursing homes, can be assisted. This will also provide additional time for nurses to aid in other health related tasks that would not have been possible otherwise.

The present invention will allow, among other things, hospital staff and caregivers at home to provide easier care for immobile patients who have lost continence of bowel and bladder. The present invention allows, among other things, nurses and caregivers to change patients in bed and is 1) easy to use by elderly spouses at home with minimal training, 2) reduces risk of stress or strain injury to nursing staff from patient turning and 3) does not injure the immobile person's fragile skin or cause pressure sores.

Referring now to FIG. 1, a schematic illustration of a turn sheet assembly system 10 according to an embodiment of the present invention is shown. Turn sheet assembly/system 10 includes a top sheet 12 attached to a bottom sheet 14. The bottom sheet typically has a length 14L and a width 14W configured and dimensioned to overlie a bed in a manner commonly known for bottom bed sheets. The top sheet 12 has a width 12W that may be equal to or different from (such as slightly greater than, for example) width 14W and a length 12L which may be equal to length 14L or different therefrom (such as slightly less than 14L, for example). The width of top sheet may be greater than the width of the mattress 20*m* of bed 20, so that the reinforced border portions 18 extend beyond the edges of mattress 20*m*. In this way, the reinforced holes 30/32 extend laterally beyond the width of the bed when the sheet 12 is not elevated above sheet 14.

The top sheet 12 is fixed to bottom sheet 14 in a lengthwise direction along a location (attachment locus 16) that is intermediate of the lengthwise edges of the sheets 12, 14. FIG. 1 shows a preferred embodiment in which sheet 12 is attached at the midline of the sheet, wherein the midline attachment locus 16 runs in the length direction and bisects the sheet 12 in the width direction. Likewise, in FIG. 1, the attachment locus 16 runs in the length direction and bisects the sheet 14 in the width direction. Alternatively, the attachment locus can be offset from the midline of the sheets, although the midline locus described with regard to FIG. 1 is preferred.

Figure 3:
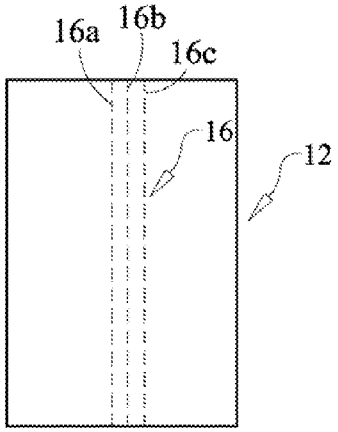
FIG. 3 illustrates an example of a fixation locus having three lines of stitches.

Preferably, the fixation along the fixation locus 16 of the top sheet to the bottom sheet is performed by sewing one or more lines of stitches along the fixation locus. FIG. 3 illustrates an example where three lines 16*a*, 16*b*, 16*c* of stitches fix the top sheet 12 to the bottom sheet 14 along fixation locus 16. Additionally, or alternatively, other means of fixation may be employed such as adhesives, staples, rivets or the like. The fixation locus 16 of top sheet 12 preferably extends along the entire length thereof as shown in FIG. 1 so as to distribute lifting forces more evenly over the whole length of sheet 12. Alternatively, the fixation locus 16 may extend over less than the entire length of sheet 12, but should extend over the majority of the length at as least as great a length as the length of the torso of the patient.

Figure 2:
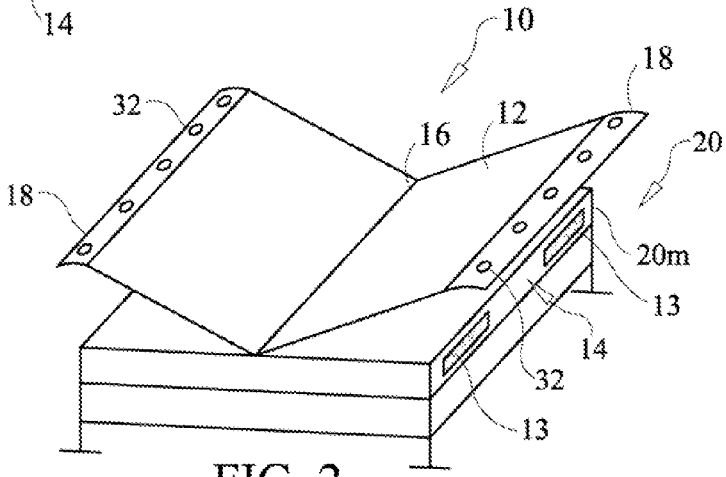
FIG. 2 is a schematic illustration of a turn sheet assembly system according to another embodiment of the present invention.

Bottom sheet 14 is preferably a commercially available sheet such as a cotton or cotton-polyester blend sheet, or any other material that is comfortable to the skin and absorbs moisture, and is fitted to the mattress beneath. Likewise, a commercially available sheet or commercially available sheet material is preferably what is used and modified to make top sheet 12. Preferably, the bottom sheet 14 and sheet material used to make top sheet 12 are at least fifty percent cotton. Bottom sheet 14 may be a flat sheet as in FIG. 1, but is preferably a fitted sheet 14, such as shown in FIG. 2. By providing bottom sheet 14 as a fitted sheet 14, the corners of the fitted sheet anchor the assembly 10 to the matters 20*m* of the bed 20, thereby helping prevent sliding, shifting and misplacement of the sheets 14 and 12 relative to the bed 20 and the patient.

Also, the top sheet 12 may have the same width as the mattress 20*m* or portion of the bottom sheet 14 (as in FIG. 1) that lies flat on top of the mattress 20*m*, or alternatively, may have a width that is greater than a width of the bed/mattress 20*m* as illustrated in FIG. 2, so that the reinforced holes 30/32 extend laterally beyond the width of the mattress 20*m* when the system is positioned in an operative position on the bed 20. In this configuration, the top sheet 12 can be is affixed to a side (or both sides) of the bed 20 when not being used for lifting, such as through use of attachment features 13. Attachment features 13 may be hook and loop type fasteners (e.g., VELCRO®) as shown, or buttons and button holes, zippers, snaps, clamps or other alternative types of fasteners that can be readily operated by a single user.

In a preferred embodiment, assembly 10 was made from an EXCLUSIVE™ sheet set manufactured by Standard Textile Company (STC). The sheet set includes a fitted sheet 14 and a bed sheet, which was modified to make top sheet 12.

Figure 5:
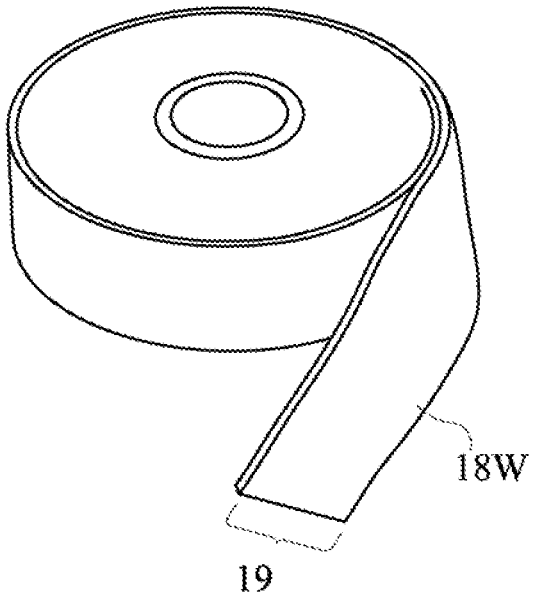
FIG. 5 illustrates a reinforcing webbing used in an embodiment of the present invention.

As part of the modification, top sheet 12 is reinforced lengthwise along first and second side portions thereof with a reinforcing material different from, typically stronger than the material from which the sheet is made to form reinforced, longitudinal border portions 18. The reinforcement material 18W attached to form border portions 18 may be polyester webbing, cotton synthetic blend or other lightweight webbing material. In one example, polyester webbing was used to reinforce the sheet at border portions 18. The polyester webbing had a width 19 (see FIG. 5) of about 5.08 cm wide and was about 0.159 cm thick. The breaking strength of the polyester webbing was about 2400 lbs.

Figure 4:
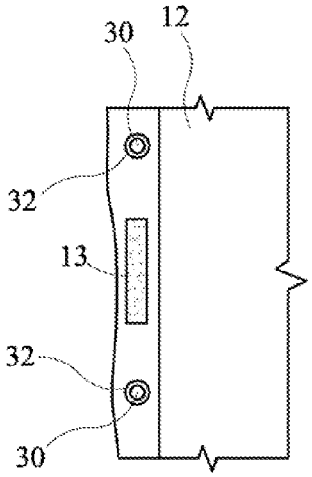
FIG. 4 is a partial view of a bottom side of a top sheet illustrating grommets and an attachment feature according to an embodiment of the present invention.
Figure 6:
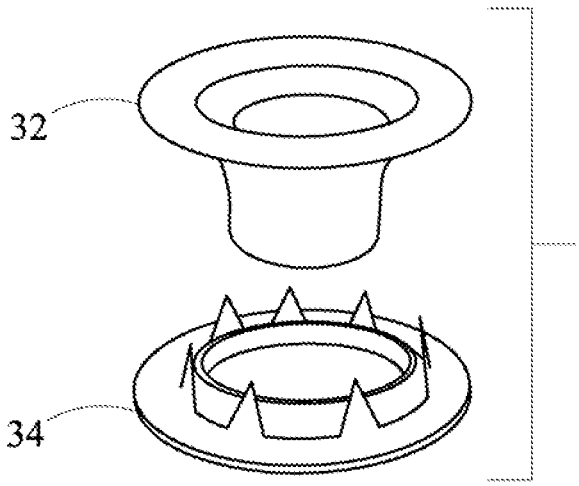
FIG. 6 illustrates a grommet and washer with teeth used to reinforce an opening according to an embodiment of the present invention.

Openings or holes 30 are formed in the reinforced border portions 18 on both sides of the top sheet 12. Additionally, openings/holes 30 may be reinforced by fixing grommets 32 therein. In the examples shown in FIGS. 1-2, ten openings 30 (five on each side) are formed in border portions 18 and reinforced with 10 grommets 32, respectively. The number of openings per side may vary from two to ten or more, but typically is about four to six. The partial view of FIG. 4 illustrates two openings 30 reinforced by brass rolled-rim grommets 32 and washers with teeth 34 (see FIG. 6) that were secured on the polyester webbing. The grommets shown in FIG. 4 have an internal diameter of about 1.91 cm and an outer diameter of about 3.91 cm. The grommet length under flange was about 1.07 cm. The materials and dimensions of grommets 32 used may vary. For example, grommets may be made of steel, stainless steel, or other suitable metal or rigid and/or reinforced polymer.

Figure 7A:
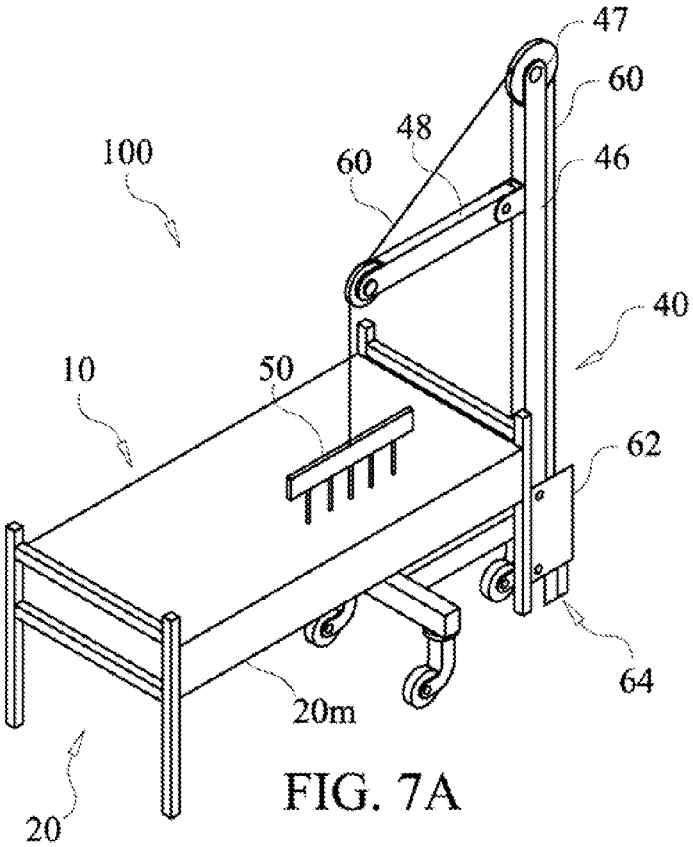
FIGS. 7A-7B schematically illustrate a system for turning a patient in bed according to an embodiment of the present invention.
Figure 7B:
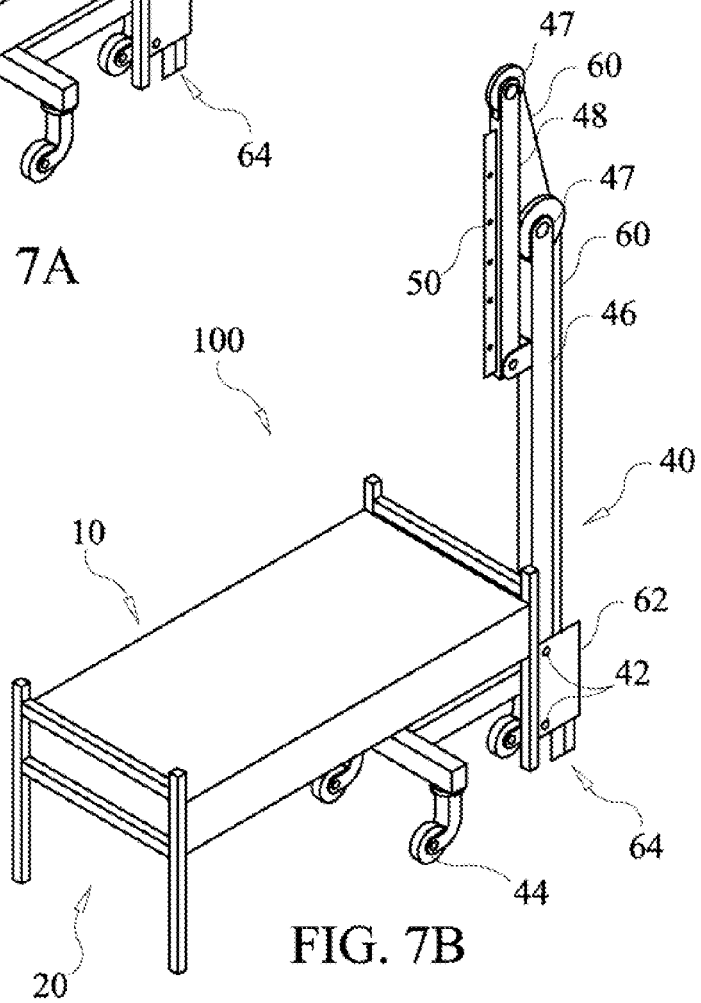

FIGS. 7A-7B schematically illustrate a system 100 for turning a patient in bed according to an embodiment of the present invention. The system 100 includes a turn sheet assembly 10 according to any of the embodiments described above, which is fitted to (as in FIGS. 2 and 8A-8D, or at least overlays as in FIGS. 1 and 7A-7B) the mattress 20*m* of bed 20. A lifting device 40 is attachable to the bed 20 by attachment features 42 such as one or more bolts, screws clamps or the like, and may be detached and moved to another location as the base of device 40 may be provided with wheels 44. A braking system (not shown) may also be provided to the wheels to prevent them from turning, which may be particularly useful if device 40 is placed adjacent the bed without fixing it to the bed.

Device 40 includes a mast 46 that extends vertically to a height above the bed 20 and a boom 48 that extends horizontally out over the bed 20 to provide a lifting point above the patient when the patient is lying on the bed 20. In the example shown in FIGS. 7A-7B, device 40 is fixed to a corner of the bed at the head of the bed. Preferably, the device 40 is positioned at the head of the bed intermediate of the corners, as shown in FIGS. 9A-9D and preferably the device 40 is fixed to the bed during use. Alternatively, device can be positioned at any location adjacent the bed where the free end of the boom can be positioned above the turn sheet system 10. Although the device 40 is preferably fixed to the bed 20 during use, it can also be used in a freestanding mode with the brakes applied.

A flexible tension member 60 is attached at one end to a lift interface bar 50 and is threaded along the boom and mast to engage with a driving mechanism 62. Flexible tension member 60 is preferably a cable but may alternatively be a belt, chain, rope or the like that is configured and dimensioned to transfer force to the lift interface bar 50 to perform the lifting functions described herein. Driving mechanism may be an electric motor, a hydraulic driving system, or other mechanical system such as a manually operated screw system. If a hydraulic system is used, the tension member 60 can be replaced by hoses and pistons as would be readily apparent to those of ordinary skill in the hydraulic power arts. In the embodiment illustrated in FIGS. 7A-7B, drive mechanism 62 is an electric motor. One or more foot pedals 64 may be provided to allow the user to operate the driving mechanism 62 without the use of the user's hands. This frees the hands of the user for other tasks and therefore facilitates the turning of the patient by a single user operating the present invention. However, even in embodiments where the driving mechanism is actuated by hand, the present invention is still useable to turn a patient by a single user.

Figure 8A:
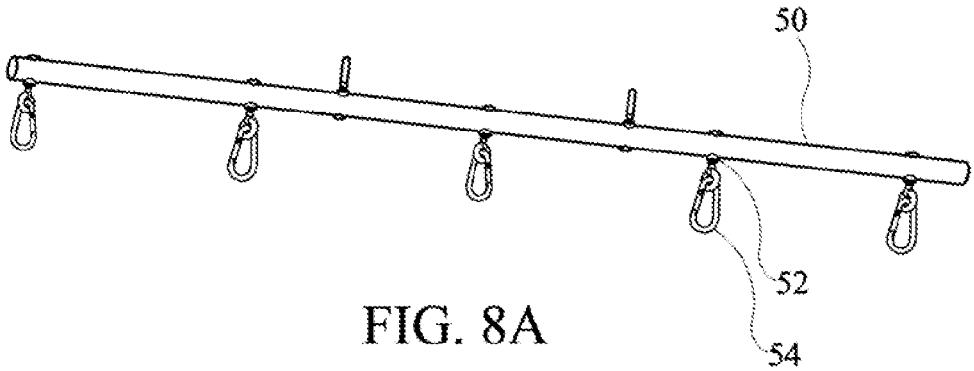
FIG. 8A illustrates a lift interface bar and attachment hardware according to an embodiment of the present invention.
Figure 8B:
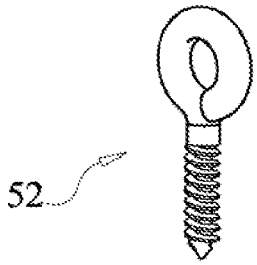
FIG. 8B illustrates an eye screw used in an embodiment of the present invention.
Figure 8C:
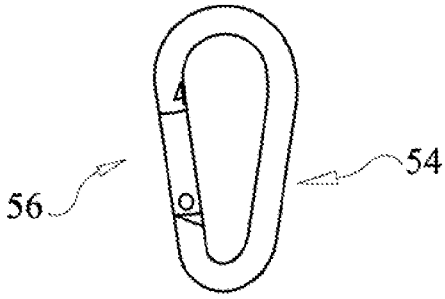
FIG. 8C illustrates a snap screw used in an embodiment of the present invention.

The lift interface bar 50 is a metal bar, preferably a hollow aluminum bar, but may be made of steel, stainless steel, or other metal or reinforced polymer suitable for supporting the loads required and also may alternatively be solid. The lift interface bar 50 connects the reinforced border 18 of the top sheet 12 to the lift device 40. The length of interface bar may be as long as the top sheet 12 or even as long as the bottom sheet, but is typically approximately equal to the average length of the adult human torso. In one example, the length of bar 50 was about 160 cm. The length of bar 50 is typically in the range of about 106 cm to about 178 cm, but may be longer, but is preferably in the range of about 160 cm to about 178 cm. In the embodiment of FIG. 8A, five eye-hole screws 52 (see also FIG. 8B) were drilled into the sheet-lift interface bar 50, which align to the openings 30 in the sheet 12.

Links 54 such as snap screws (FIGS. 8A, 8C) were attached to the eye-hole screws 52 (see FIG. 8A), and can be manually passed through openings 30 (by manipulating latch mechanism 56) for securely connecting sheet 12 to bar 50. As with the openings 30 in sheet 12 fewer or more than five attachment locations/eye-hole screws can be provided on bar 50 and the number and spacing of these attachment locations will typically correspond to the number and spacing of openings 30 per side on sheet 12. Also, attachment hardware other than the preferred attachment hardware may be substituted. For example, hooks, straps or other attachment hardware may be substituted for eye hole screws 52 and hooks, straps, snaps, clamps or other attachment hardware may be substituted for snap screws to function as links 54.

Advantageously, links 54 are operable by a single user to attach or detach the sheet 12 (through reinforced openings 30, 32) to or from the lift interface bar 50, and the single user requires no tools to perform the attach and detach operations.

Tension member 60 is guided by pulleys 47 along boom 48 and mast 46. As illustrated in FIG. 7B, boom 48 is pivotally mounted to mast 46 so that it (along with sheet-lift interface bar 50) can be rotated to a stowed position when not in use.

Figure 9A:
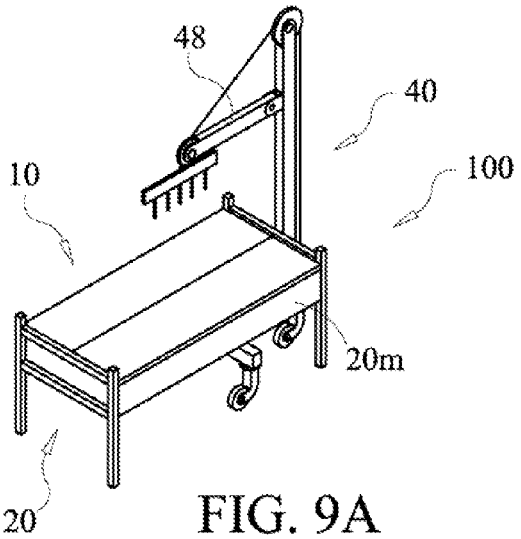
FIGS. 9A-9D schematically illustrate use of a system to turn a patient in bed according to an embodiment of the present invention.
Figure 9B:
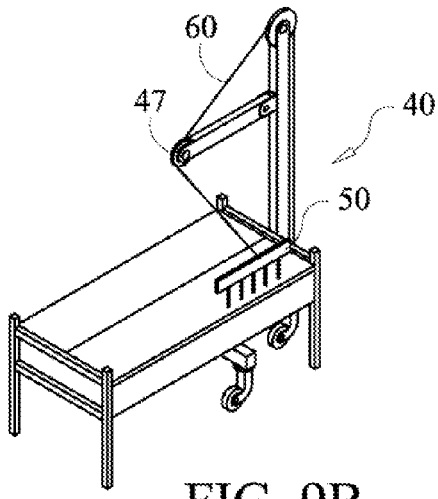

FIGS. 9A-9D schematically illustrate use of the present invention to turn a patient according to an embodiment of the present invention. Although not shown in the figures, the patient would be lying on the top sheet 12 between the borders 18, preferably over or near the center of the bed 20. In FIG. 9A, boom 48 is positioned in the operative, horizontally extending orientation if it is not already there. The patient would be lying in bed 20 on the top sheet 12, as already noted.

Next, the operator operates the drive mechanism to let out the tension member 60, so that sheet-lift interface bar 50 can be brought in close proximities to the openings 30 of the top sheet 12 on the side of the sheet 12 that is to be lifted. In embodiments where the drive mechanism 62 is activated by a foot pedal 64 to raise or lower the sheet-lift interface bar 50, this allows the operator to keep her/his hands free to guide and handle the patient during the turning process. Significant for its slight horizontal turn capabilities, the guide pulley wheel 47 at the end of the boom 48 allows the user to pull the interface bar 50 towards the edge of the bed 20, to either side of the bed. Next, the user connects the lift interface bar 50 to sheet 12 by connecting links 54 through reinforced openings 30, 32.

Figure 9C:
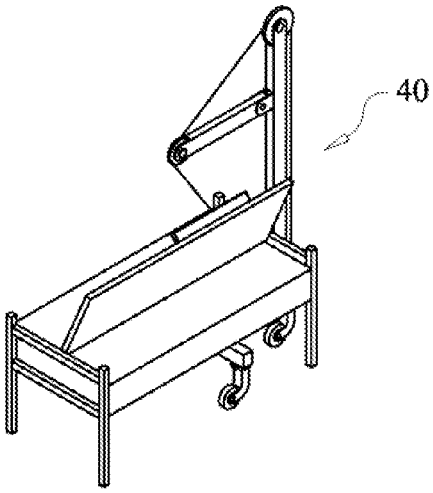

Once the sheet 12 has been connecting, the user operates the lift device 40 to take up some of the tension member 60, thereby apply an upward lifting force to the lengthwise border portion 18, thereby lifting a portion of the top sheet 12 relative to a bottom sheet 14 of the turn sheet assembly underlying the top sheet, as illustrated in FIG. 9C, and this causes the patient to turn. Drive mechanism 62 may be programmed so as not to exceed a maximum height to as to prevent turning the patient too far as well as prevent accidentally rolling the patient off of the bed. Additionally, or alternatively, the height of boom 48 above the bed and placement of the boom centrally of the sides of the mattress (or in some other predetermined location) can be pre-calculated to physically prevent bar 50 from being lifted to an unsafe level. Still further, the fixation of top sheet 12 to bottom sheet 14 along fixation locus 16 prevents lifting of the top sheet 12 relative to the bottom sheet 14 on a side of the top sheet opposite the lengthwise border portion 18 that is connected to the lifting device 40/lift bar 50.

Figure 9D:
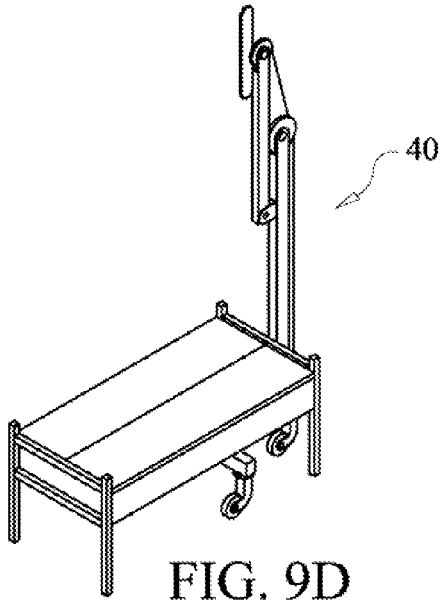

After satisfactory completion of the turning operation, the user again actuates the drive mechanism to let out the tension member 60 until it no longer applies a lifting force to the sheet 12. The sheet 12 is then disconnected by disconnecting links 54 from openings 30. The top sheet 12 may be affixed to the side of the bed to maintain the top sheet 12 in place when not being used for lifting, in a manner as described above. The user can than actuate the drive mechanism to take in the tension member 60 and draw bar 50 up adjacent to the pulley 47 like the configuration shown in FIG. 9A. Next, the boom 48 can be pivoted back to its stowed position, as illustrated in FIG. 9D, to avoid interference with the patient's environment.

It is noted that the system 100 as shown in FIG. 9A can further be used to turn the patient in a reverse direction. This process can be carried out in the same manner described above, except that when the operator lets out the tension member 60 as in FIG. 9B, the operator instead draws the bar 50 to the opposite side of the bed 20 to prepare for connection to the openings 30, 32 on the opposite border 18 of the sheet 12.

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, material, composition of matter, process, process step or steps, to the objective, spirit and scope of the present invention. All such modifications are intended to be within the scope of the claims appended hereto.

That which is claimed is:

1. A turn sheet system for turning a patient in a bed, said system comprising:

a bottom sheet having a first length and a first width configured and dimensioned to overlie the bed; and a top sheet having a second length and a second width;

wherein said top sheet is fixed to said bottom sheet along a location extending intermediate of said second width and along a majority of said second length;

wherein said top sheet is reinforced lengthwise along first and second side portions thereof with a reinforcing webbing material different from and stronger than a sheet material that said top sheet is made from, to form reinforced, longitudinal border portions of said top sheet; and further comprising reinforced holes formed in said longitudinal border portions.

2. The system of claim 1, wherein said top sheet is fixed along a line extending in the middle of said second width dimension, in a direction along said second length.

3. The system of claim 1, wherein said top sheet is fixed to said bottom sheet by sewing said top sheet to said bottom sheet.

4. The system of claim 1, wherein said bottom sheet is a fitted sheet configured and dimensioned to fit to the bed, thereby anchoring said system relative to the bed.

5. The system of claim 1, wherein said second width is greater than a width of the bed so that said reinforced holes extend laterally beyond the width of the bed when said system is positioned in an operative position on the bed and said top sheet is affixed to a side of the bed when not being used for lifting.

6. The system of claim 1, wherein said second width is equal to or greater than a width of a mattress of the bed.

7. A system for tuning a patient in bed, said system comprising:

a turn sheet assembly comprising a bottom sheet having a first length and a first width configured and dimensioned to overlie the bed and a top sheet having a second length and a second width, wherein said top sheet is fixed to said bottom sheet along a location extending intermediate of said second width;

a reinforced longitudinal border portion, reinforced with a webbing material, formed in said top sheet;

a plurality of reinforced openings formed in said longitudinal border portion;

a lifting device attachable to the bed and including a boom extending over and above the bed;

an attachment feature configured to attach said lifting device to the bed; and attachment hardware configured and dimensioned to temporarily attach said reinforced openings to said lifting mechanism;

wherein said lifting device includes a lifting mechanism configured and dimensioned to apply a lifting force to the reinforced openings when attached to said lifting device, thereby lifting said reinforced longitudinal border portion.

8. The system of claim 7 wherein said attachment hardware includes a lift interface bar fixed to said lifting device, and links configured and dimensioned to pass through said reinforced openings and releasably attach said reinforced openings to said lift interface bar.

9. The system of claim 8, wherein a flexible, tensile member is routed along said boom and interconnects said lift interface bar with said lifting mechanism, wherein said lifting mechanism is configured to take up a portion of the tensile member when operated in a first direction, thereby relatively shortening a distance between said lift interface bar and said lifting mechanism and lifting said lift interface bar and said reinforced openings, thereby lifting a portion of said top sheet causing the patient to turn, said lifting mechanism being further configured to let out a portion of the tensile member when operated in a second direction, thereby relatively lengthening the distance between said lift interface bar and said lifting mechanism and lowering said lift interface bar relative to the bed.

10. The system of claim 8, wherein said links are operable by a single user to attach or detach said reinforced openings to or from said lift interface bar, and wherein the single user requires no tools to perform the attach and detach operations.

11. The system of claim 7, wherein said top sheet is fixed to said bottom sheet along center lines dividing the top and bottom sheets in equal halves widthwise.

12. The system of claim 7, wherein said top sheet is fixed to said bottom sheet by sewing said top sheet along a line of attachment.

13. The system of claim 7, wherein said reinforced openings are reinforced by grommets.

14. The system of claim 7, wherein said bottom sheet is a commercially available fitted sheet and said top sheet is made by modifying a commercially available sheet.

15. The system of claim 14, wherein said top and bottom sheets are made of cotton or a cotton blend.

16. A turn sheet system for turning a patient in a bed, said system comprising:

a fitted bottom sheet having a first length and a first width configured and dimensioned to overlie the bed; and an integral top sheet having a second length and a second width;

wherein said top sheet is irremovably fixed to said bottom sheet along a location extending intermediate of said second width and along a majority of said second length; and a lifting device, the lifting device attachable to one side of the to sheet and programmable so as not to exceed a maximum height to prevent turning the patient too far.

17. The system of claim 16, wherein said second width is equal to or greater than the width of a mattress of the bed.

18. The system of claim 16, wherein said bottom sheet is a commercially available fitted sheet and said top sheet is made by modifying a commercially available sheet.

* * * * *